US007804478B2

(12) United States Patent
Schou

(10) Patent No.: US 7,804,478 B2
(45) Date of Patent: Sep. 28, 2010

(54) FEEDBACK CONTROL DEVICE FOR PHOTO-COLORIMETRIC PARAMETERS FOR A LIGHT BOX WITH COLOR LEDS

(75) Inventor: Guy Schou, Le Bouscat (FR)

(73) Assignee: Thales (FR)

( * ) Notice: Subject to any disclaimer, the term of this patent is extended or adjusted under 35 U.S.C. 154(b) by 1058 days.

(21) Appl. No.: 10/554,357

(22) PCT Filed: Mar. 29, 2004

(86) PCT No.: PCT/EP2004/050388

§ 371 (c)(1),
(2), (4) Date: Oct. 25, 2005

(87) PCT Pub. No.: WO2004/097784

PCT Pub. Date: Nov. 11, 2004

(65) Prior Publication Data

US 2006/0256049 A1 Nov. 16, 2006

(30) Foreign Application Priority Data

Apr. 25, 2003 (FR) ..... 03 05125

(51) Int. Cl.
*G09G 3/36* (2006.01)

(52) U.S. Cl. ..... 345/102; 345/76; 345/82; 345/84; 345/87

(58) Field of Classification Search ..... 345/30, 345/35, 39, 44, 46, 55, 76, 82, 83, 84, 87, 345/102; 362/217, 219, 227, 230, 231, 235, 362/236, 237, 238, 240, 249, 251, 800
See application file for complete search history.

(56) References Cited

U.S. PATENT DOCUMENTS 5,270,818 A * 12/1993 Ottenstein ..... 348/602

(Continued)

FOREIGN PATENT DOCUMENTS

EP 0 313 331 A 4/1989

(Continued)

*Primary Examiner*—My-Chau T Tran
(74) *Attorney, Agent, or Firm*—Lowe Hauptman Ham & Berner, LLP

(57) ABSTRACT

The field of the invention is that of light boxes used for illuminating optical-valve displays, especially matrix liquid-crystal displays (or LCDs). The illumination from light boxes can at the present time be produced by light-emitting diodes that emit in various spectral bands so as to reconstruct white illumination. For a number of applications, in particular aeronautical applications, it is necessary to maintain the photometric and colorimetric characteristics of this illumination independently of the environmental and ageing conditions of the components. The invention provides an electronic feedback control device for maintaining the photometric and colorimetric characteristics of this illumination at given setpoint values without introducing disturbing optoelectronic devices into the light box. Several possible technical solutions are described.

11 Claims, 5 Drawing Sheets

U.S. PATENT DOCUMENTS 5,724,062 A * 3/1998 Hunter ..... 345/102
5,786,801 A 7/1998 Ichise
6,305,818 B1 * 10/2001 Lebens et al. ..... 362/184
6,344,641 B1 * 2/2002 Blalock et al. ..... 250/205
6,659,622 B2 * 12/2003 Katogi et al. ..... 362/219
6,674,060 B2 * 1/2004 Antila ..... 250/205
6,888,529 B2 * 5/2005 Bruning et al. ..... 345/102
7,148,632 B2 * 12/2006 Berman et al. ..... 315/189
7,178,941 B2 * 2/2007 Roberge et al. ..... 362/225
2002/0070914 A1 * 6/2002 Bruning et al. ..... 345/102
2002/0113192 A1 * 8/2002 Antila ..... 250/205
2002/0114155 A1 * 8/2002 Katogi et al. ..... 362/219
2002/0122019 A1 9/2002 Baba et al.
2004/0051691 A1 * 3/2004 Hedrick ..... 345/102

FOREIGN PATENT DOCUMENTS

JP 59 195627 A 3/1985

* cited by examiner

FEEDBACK CONTROL DEVICE FOR PHOTO-COLORIMETRIC PARAMETERS FOR A LIGHT BOX WITH COLOR LEDS

CROSS-REFERENCE TO RELATED APPLICATIONS

The present Application is based on International Application No. PCT/EP2004/050388, filed on Mar. 29, 2004, which in turn corresponds to FR 03/05125 filed on Apr. 25, 2003, and priority is hereby claimed under 35 USC §119 based on these applications. Each of these applications are hereby incorporated by reference in their entirety into the present application.

FIELD OF THE INVENTION

The field of the invention is that of light boxes (LBs) used for illuminating optical-valve displays, especially matrix liquid-crystal displays (or LCDs). It relates more particularly to polychromatic displays having light boxes emitting white light.

The invention relates to the calorimetric and photometric control of the light emitted by said light boxes.

The field of application is more particularly that of displays on board aircraft, but it can be used for any application requiring optical-valve displays having precise calorimetric or photometric tolerances (computer monitors, portable computer screens, etc.).

DESCRIPTION OF THE PRIOR ART

The displays on board aircraft have particularly stringent characteristics and specifications. These are in particular:

- a high luminance (typically of the order of several thousand cd/m$^2$);
- a wide dynamic luminance range (or dimming range) so as to be able to be used in daylight and at nighttime;
- precise calorimetric characteristics independent of the ageing of the component;
- a long lifetime and high reliability;
- a great robustness in specific aeronautical environments (extreme temperatures, depressurization, moisture, salt fog, shock and vibration, etc.); and
- low weight and low volume.

Until recently, the only light sources for illuminating optical valves have been fluorescent tubes. Two broad types of fluorescent tubes exist:

- HCFL (hot cathode fluorescent lamp) tubes, which are internally preheated and operate at moderate excitation voltages; and
- CCFL (cold cathode fluorescent lamp) tubes have the advantage of not having internal preheating. They require higher excitation voltages but allow tubes to be produced with a very small diameter (a few millimeters) and they have a longer lifetime. They are generally preferred to HCFLs.

However, the use of CCFL tubes has many drawbacks:

- they require a high supply voltage, which may be up to 2000 volts AC. The main consequences of this are:
  - the use of specific coiled components, these being bulky, heavy, expensive and not very reliable,
  - the use of specific printed and wiring circuits which increase the cost and the production time,
  - the use of complex assembling and finishing technologies, necessary for ensuring correct operation even in the event of depressurization, high humidity or thermal shock,
  - the risk of electric arcs (with smoke generation) in the event of component failure and
  - the emission of substantial electromagnetic radiation difficult to control insofar as radiation is by nature emitting at the front face of the displays;
- they have a limited luminance dynamic range.

Dimming is conventionally obtained by time modulation of the emitted luminance. Below a certain ignition time, the fluorescent lamp behaves erratically. Periods of extinction of the tube, called flicker, are then perceived;

- their optical characteristics vary over time. The performance of the fluorescent lamps is degraded due to the following phenomena:
  - depletion of vaporized gas (mercury vapor),
  - reduction in the emissive power of the electrodes,
  - opacification of the glass of the fluorescent tube and
  - loss of efficiency of the phosphors coating the inside of the tube, which behave differently and change the color of the light emitted;
- their photometric efficiency at low temperature is poor and cold starts reduce their lifetime;
- poor performance of the fluorescent tubes when started up after being off for a long time (delay in the first light appearing, followed by chaotic operation);
- the ends of the fluorescent tubes, which do not emit light, are quite long, often more than one centimeter;
- they are relatively fragile due to their material (glass tube) combined with a small diameter (around 2 millimeters) and to long length, which may exceed 200 millimeters;
- it is tricky to fix them, requiring mechanical retention and electrical insulation;
- their poor thermal control due to a little heat dissipation drained away by conduction through the structure, heat being removed only by natural convention; and
- the risk of obsolescence of these very specific components, which are difficult to replace.

In recent years, it has also been envisaged to replace these light sources with light-emitting diodes or LEDs. Light-emitting diodes have many advantages:

- they are semiconductor components that can be easily integrated into printed circuits;
- they require low supply voltages in order to operate;
- the emission spectra cover the entire visible spectrum;
- they have a very wide bandwidth, permitting a wide dynamic luminance range using time modulation of their control voltage; and
- they are very reliable and have a long lifetime.

It should also be noted that a light box based on LEDs require a larger number of components than a box based on fluorescent tubes, and consequently the death of an LED may result in a less significant drop in luminance than the extinction of a fluorescent tube.

There are two broad types of light box. In a first embodiment, the optical valve is illuminated by a matrix of LEDs lying in a plane located beneath the optical valve. In a second embodiment, the LEDs lie on the periphery of the optical valve, along the edge of a lightguide that sends the light from the LEDs to the imager.

However, until recently their use was limited insofar as the photometric efficiency of LEDs, that is to say the percentage of electrical energy converted effectively into light energy, remained quite poor and considerably lower than that of fluorescent tubes.

Recent progress has allowed LEDs to be produced that have efficiencies close to those of fluorescent tubes. To obtain white light, various solutions can then be envisaged.

It is possible to use:

LEDs initially emitting in the blue, which are coated with a yellow phosphor that converts some of the blue light emitted into yellow radiation, the final color of the light emitted—a mixture of blue and yellow—being white;

LEDs initially emitting in the blue and coated with three phosphors emitting in three different spectral bands (conventionally, red, green and blue), the final color of the emitted light—a mixture of blue, green and red—being white;

monolithic components integrating, on a single chip, three LEDs emitting in three different spectral bands. The mixture of the colors is obtained by a common encapsulation optic;

components hybridizing three LEDs emitting in three different spectral bands; and three different types of LEDs, emitting in three different spectral bands. In this case, the light box produces the mixture of the various colored lights so as to obtain a uniform white color.

The use of blue LEDs coated with a yellow phosphor has several drawbacks. Firstly, the photometric efficiency of the order of 25 lumens/watt of the best LEDs still remains below that of fluorescent tubes, which is of the order of 50 lumens/watt. Secondly, the emitted luminance substantially decreases with operating time. The emitted luminance may thus fall by a half after 10,000 hours of operation. Thirdly, the red component of the light emitted is generally quite weak. Finally, the luminance efficiency of the yellow phosphor varies with temperature, with the period of operation and with the manufacturing conditions. These variations in efficiency result in variations in calorimetric response that are not easily controllable.

The use of LEDs initially emitting in the blue and coated with three phosphors emitting in three different spectral bands partly solves the problems of blue diodes with a yellow phosphor. This is because the calorimetric response obtained is more satisfactory and its variations with the operating time are more limited. However, the luminance efficiency is not satisfactory and this type of component remains marginal in the LED market, thereby posing long-term supply or obsolescence problems.

In theory, monolithic or hybrid components result in better colorimetric efficiencies. However, these technologies, which are complex to implement, remain marginal.

The most promising solution in the medium term therefore consists in the use of three different types of LED emitting in three different spectral bands. This is because this solution provides high efficiencies insofar as the light emitted by the LEDs is no longer attenuated by the conversion phosphors. The LEDs used are components that are simple to manufacture and to use. In this case, the light box mixes the various colored lights output by each type of LED, so as to obtain a uniform white color. To produce satisfactory mixing of the colors, it is for example sufficient for the light box to have a sufficient depth. The technological process for manufacturing the various types of LED does not, however, guarantee perfect reproducibility of the photometric and colorimetric characteristics. This point can be easily solved by using separate independent electrical control systems for each type of LED. To obtain the desired calorimetric response, it therefore suffices to increase or decrease the respective intensities in each system.

However, this solution has a major drawback. This is because the photometric and colorimetric characteristics of the LEDs vary with their period of operation and with temperature in a different manner, thus modifying the calorimetric response and the intensity of the white light emitted.

It is known to use feedback control systems which make it possible, on the basis of photometric and calorimetric measurements made in the light box, to modify the electrical control signals for the light-emitting diodes so as to reestablish photometric parameter setpoint values. However, the measurement devices necessarily disturb the proper operation of the LB. This is because either these devices are located in the useful area of the lighting unit and introduce calorimetric response and luminance nonuniformities, or these devices are located outside the useful area of the lighting unit, but in this case the lighting unit is larger than that of the optical valve, thus increasing the final size of the display. The object of the invention is to alleviate these drawbacks by providing photometric or calorimetric measurement devices that can be located outside the light box.

SUMMARY OF THE INVENTION

More precisely, the subject of the invention is an electronic device for feedback control of photometric or calorimetric characteristics for a light box for illumination of optical-valve imagers, especially matrix liquid-crystal screens, said box comprising at least a first and a second array of light-emitting diodes, said arrays being controlled by an electric control circuit, the first array consisting of a first type of diode emitting light in a first spectral band, the second array consisting of a second type of diode emitting light in a second spectral band, said electronic feedback control device comprising an electronic processing/computing unit for driving the electronic control circuit for the arrays of light-emitting diodes and optoelectronic devices for measuring the photometric and calorimetric characteristics of the light-emitting diodes connected to said electronic processing/computing unit, said optoelectronic devices including at least a first optoelectronic assembly consisting of a light-emitting diode, of identical type to one of the types of diodes of the light box, and of a photosensitive sensor placed facing said light-emitting diode, said diode being controlled by the electronic control circuit for the arrays of diodes for the light box controlling this type of diode, said assembly comprising means or a structure for isolating it from the external light and said assembly being placed in an environment close to that of the light box.

BRIEF DESCRIPTION OF THE DRAWINGS

The invention will be more clearly understood and other advantages will become apparent on reading the description that follows, given without any limitation, and from the appended figures in which.

MORE DETAILED DESCRIPTION

Figure 1:
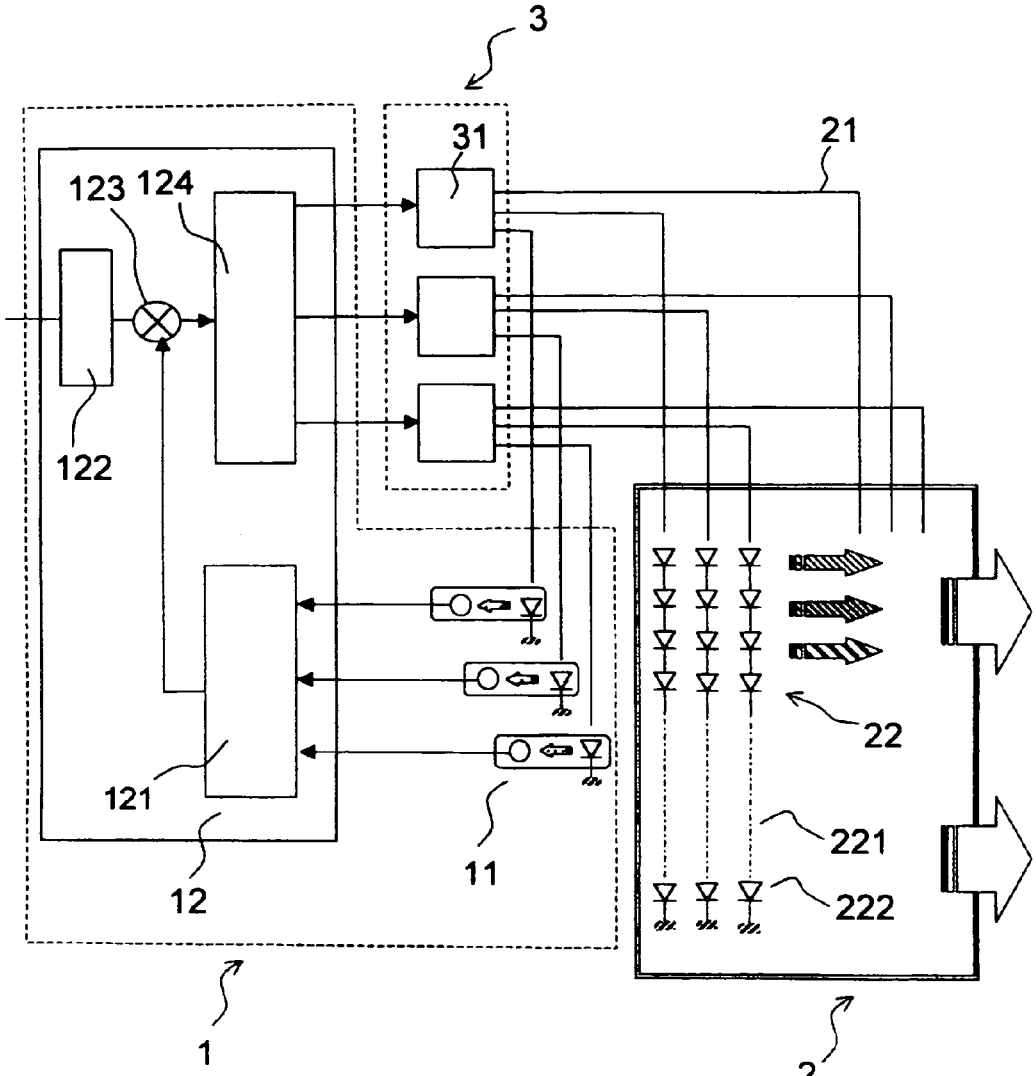
FIG. 1 shows a general diagram of the light box and of the feedback control device according to the invention.

FIG. 1 shows a general diagram of an electronic assembly that includes the feedback control device according to the invention. The assembly comprises three parts: the light box 2, the feedback control device 1 and a unit comprising the electronic control circuits 3 for the arrays of light-emitting diodes. Each electronic control circuit comprises several control modules 31. Each electronic module 31 controls one type of diode.

The light box comprises several arrays 22 of diodes as shown in FIG. 1. Each array comprises light-emitting diodes of the same type. Each array 22 is formed from several branches 221 that are connected to an electronic control module 31 via electrical links 21, each branch 221 comprising LEDs 222 of the same type connected in series. Of course, other arrangements are possible (especially matrix arrangements of the LEDs). The light-emitting diodes 222 of the various arrays 22 emit in different spectral bands. Conventionally, to obtain white light, it is necessary to produce subassemblies comprising three different types of diode emitting in the red, green and blue (hatched arrows in the figure). However, the devices according to the invention may operate with other LED arrangements. For the sake of clarity, the optical devices for mixing the colored lights coming from the LEDs in order to illuminate the imager (broad white arrows) have not been shown. These devices are known to those skilled in the art.

Each branch 221 of one type of LED is controlled by an independent electronic control circuit 31. In general, the light-emitting diodes are controlled through the electric current, the photometric properties of the diodes depending directly on this electric current.

The electronic feedback control device 1 framed by the dotted lines in FIG. 1, comprises essentially an electronic processing/computing unit 12 and optoelectronic devices 11 for measuring the photometric and calorimetric characteristics of the light-emitting diodes. Each of said devices comprises a light-emitting diode of the same type as one of the types of diode in the light box and a photosensitive sensor placed facing said light-emitting diode, said diode being controlled by the electronic control circuit 3 for the arrays of diodes in the light box that controls this type of diode. Said optoelectronic device is isolated from the external light, especially by a closed cap or simply because the distance separating the diode from the photosensitive sensor is small enough to avoid any substantial effect of the parasitic light. Said optoelectronic device is placed in a thermal environment close to that of the light box.

This arrangement of the optoelectronic devices 11 is based on the very great similarity in thermal behavior and in drift over time of light-emitting diodes, which are purely semiconductor components. Consequently, when exposed to identical or similar conditions, their characteristics will vary in the same way. It is therefore unnecessary to measure the photometric or calorimetric characteristics directly on the diodes in the light box. This measurement may be carried out on identical diodes outside the light box provided that they are controlled by identical electric currents and voltages and provided that they are exposed to the same environment. One possibility for the possible fitting of the optoelectronic measurement devices is on the rear face of the lighting card on which the LEDs in the light box are produced. This is because these diodes are generally produced in SMD (surface mount device) packages and consequently their temperature essentially depends on the temperature of the circuit, which is identical on both its faces.

Another major advantage of this arrangement is that all the initial errors in installing the electronic devices (variation in the light levels emitted by the LEDs, misalignment of the photosensors, variation in the sensitivity of said photosensors, variation in the electronic control circuits for the arrays of LEDs, etc.) has no impact on the quality of the feedback control insofar as the latter always tends to bring the detected light levels beck to their initial level.

The electronic processing/computing unit comprises at least:

- a storage unit 122 for storing setpoint values of the photometric and colorimetric parameters;
- a processing unit 121 for processing the data coming from the various photosensitive sensors, said unit being connected to the optoelectronic measurement devices;
- an electronic comparator 123 for comparing the data coming from the processing unit with the setpoint values; and
- a control unit 124 connected, on one side, to the electronic comparator and, on the other side, to the electronic control circuits for the arrays of light-emitting diodes, making it possible to maintain the setpoint values of the photometric and colorimetric parameters.

The operation of the overall device will be described below.

The luminance of the display must be able to be adjusted insofar as the illumination conditions may vary very substantially between daytime illumination and nighttime illumination. This luminance setpoint may be provided either by the user or by an ancillary system that measures the ambient brightness, this system not being shown in the various figures.

Consequently, the luminance feedback control must be integrated into the colorimetric feedback control device.

The luminance setpoint is supplied to the unit 122 for storing the setpoint values of the photometric and calorimetric parameters, which already contains the setpoint values of the calorimetric parameters. Preferably, these calorimetric setpoint values result from an initial adjustment carried out as follows. For a given luminance setpoint, the currents delivered into the various arrays of LEDs is adjusted until the desired mixed light is obtained. This point is checked for example using a photocolorimeter or a spectrometer. When this light is obtained, the measurements delivered by the optoelectronic devices 11 are stored in the unit 122. This method eliminates all the inaccuracies in the system and requires no prior calibration of said optoelectronic devices.

This storage unit 122 sends, via the electronic comparator 123, the setpoint values to the control unit 124. For the sake of clarity, the operation of the comparator will be explained later. The main function of said unit is to convert the photometric and calorimetric setpoint values into electronic setpoint values that can be used for the electronic control circuits 31 for controlling the arrays of light-emitting diodes.

The electronic control circuits for controlling the arrays of LEDs generate, on the basis of these electronic setpoint values, the control currents that are delivered to the various arrays of diodes 222 and to the optoelectronic measurement devices 11. In order to generate identical currents in the measurement devices 11, current-mirror electronic devices are preferably used. The LEDs generate colored light (hatched arrows in FIG. 1). The various colored lights are mixed in order to form a uniform illumination (broad white arrows), generally white in color, for the imager.

Each photosensor receives a light flux coming from its associated LED (small hatched arrows in FIG. 1). This flux depends on two main parameters, these being, on the one hand, the LED control current and, on the other hand, the possible variations due either to ageing of the LED or to modifications in its characteristics as a function of the environment, and in particular the thermal environment. The electrical signals output by the sensors are sent to the processing unit 121.

The main function of the processing unit is to convert this data into photometric and calorimetric parameters of the same type as the setpoint values delivered to the electronic comparator 123. The comparator 123 compares the setpoint values coming from the electronic storage unit 122 with the values measured by the sensors coming from the unit 121. If these values are identical, the setpoint values are sent to the control unit 124 without being modified. If they are different, the comparator increases the measured values if they are below the setpoint values and decreases them if they are above the setpoint values using feedback control techniques known to those skilled in the art.

Figure 2:
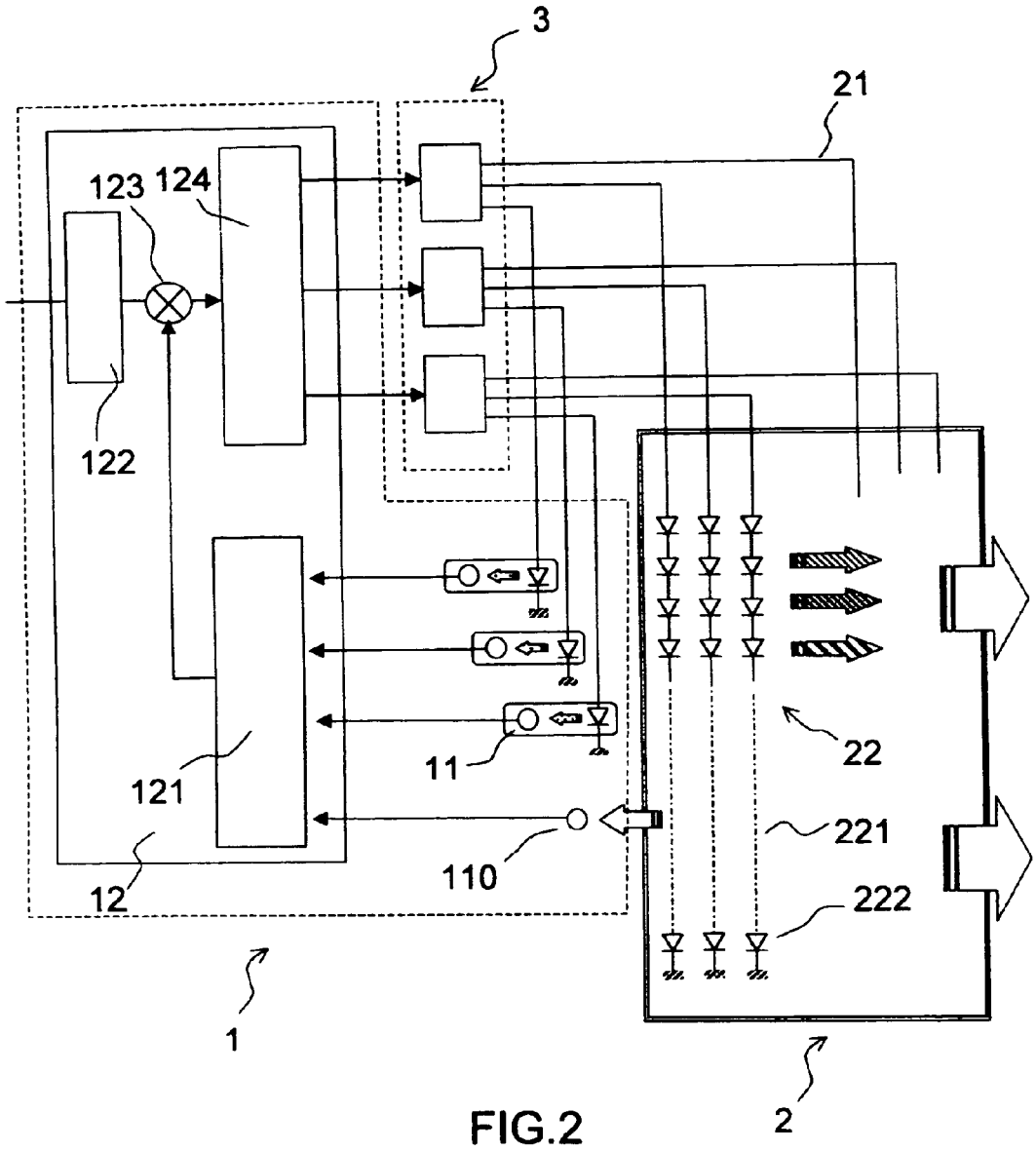
FIG. 2 shows an alternative embodiment of the device of FIG. 1.

FIG. 2 shows an alternative embodiment of the device of FIG. 1. An additional device 110 has been added. This device 110 essentially comprises at least one photosensitive sensor that measures the light inside the light box directly. This sensor may be mounted, for example, either inside the actual light box, or on the outside, and in this case an opening is made in the light box for the light flux to be transmitted to the sensor. This sensor is also connected to the processing unit 121. This arrangement provides redundancy in the measurements obtained by the devices described above and said sensors thus provide security of measurement. This arrangement also makes it possible to separate the colorimetric measurement devices essentially provided by the devices 11 from the photometric measurement devices provided by the photosensitive sensor 110 which measures the light inside the light box directly.

Figure 3:
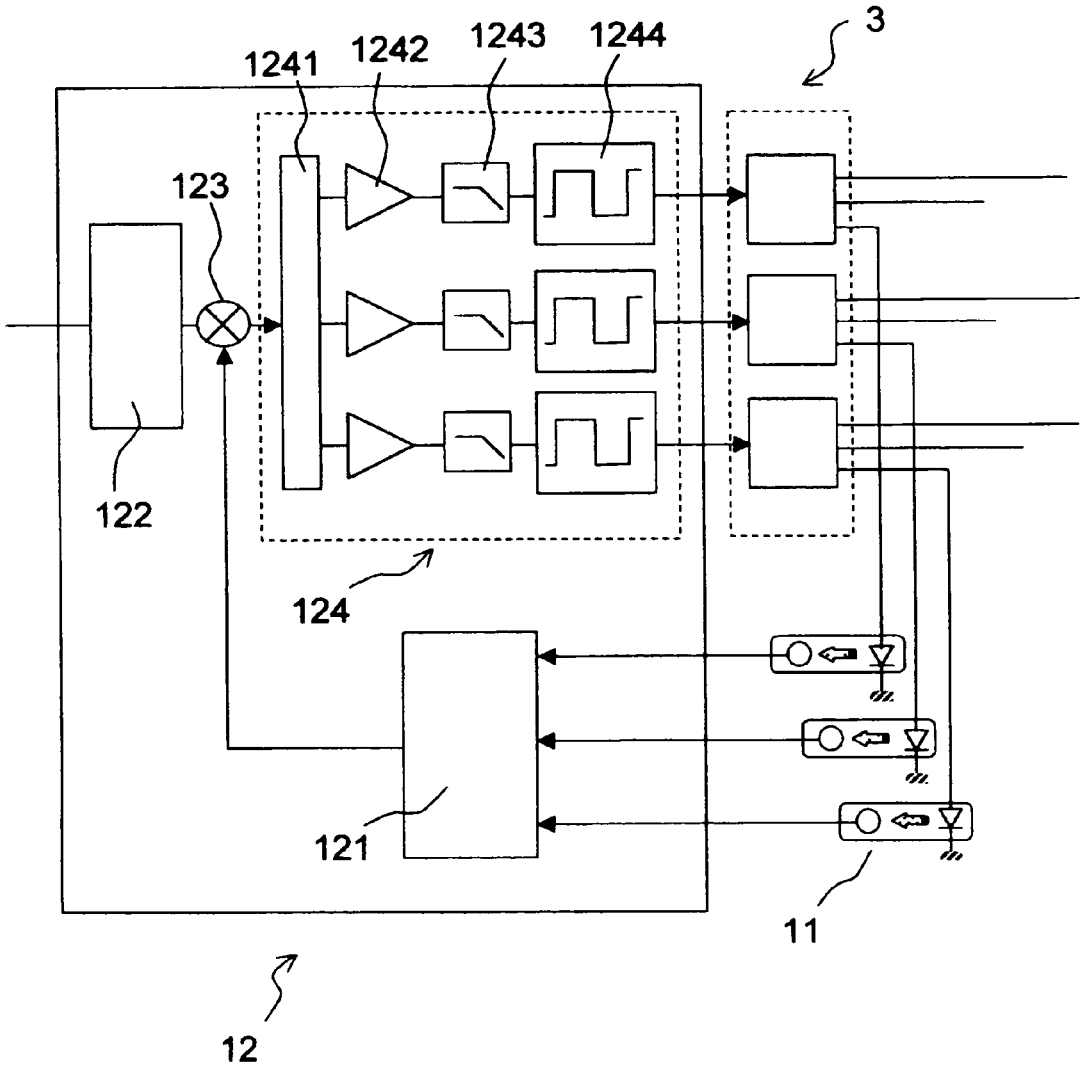
FIG. 3 shows a first embodiment of the electronic processing/computing unit of the feedback control device according to the invention.

The arrays of LEDs are preferably controlled by the technique called PWM (pulse width modulation). This technique consists in periodically modulating the electric current delivered to the LEDs. Within a given time period $T_0$, the maximum electric current corresponding to the maximum light flux is delivered for a time T proportional to the light flux that it is desired to obtain. The current is zero during the rest of the time period, equal to $T_0-T$. For example, if a light flux equal to one half of the maximum flux is desired, the current will be delivered over one half of the time period. FIG. 3 shows in detail the principle of operation of the control unit 124 in one particular PWM operating mode. In this arrangement, the unit 124 comprises as many electronic channels as there are types of LED. For example, if the light box has three types of LED, as indicated in FIG. 3, in this case the control unit will have three channels, each channel driving a control module 31. The control unit has a first electronic unit 1241 for shaping the setpoint values. This unit delivers the initial control signals intended for the arrays of LEDs. Each initial signal is amplified by an amplifier device 1242 and then filtered by a filter device 1243. Finally, the signal undergoes pulse width modulation by the device 1244. The final signal thus shaped is delivered to the control module 31 in question.

Figure 4:
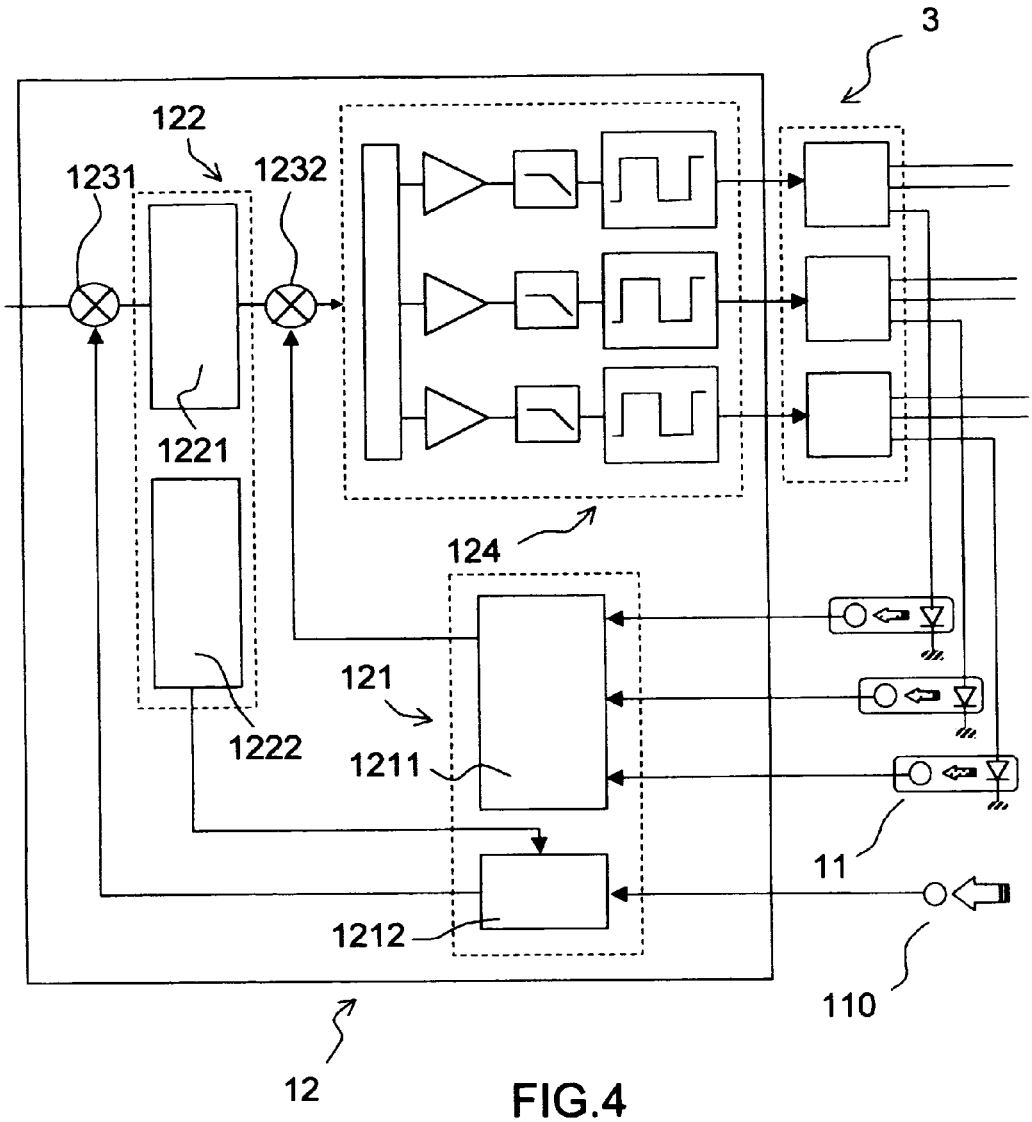
FIG. 4 shows a second embodiment of the electronic processing/computing unit of the feedback control device according to the invention.

FIG. 4 shows a first alternative embodiment of this electronic configuration when the device includes, as shown in FIG. 2, a sensor that measures the light flux in or near the light box directly. It is then possible for the luminance setpoint and the calorimetric setpoints to be separately feedback-controlled by two comparators 1231 and 1232, as indicated in FIG. 4. The processing device 121 then comprises two separate electronic modules 1211 and 1212, the first dedicated to the devices 11 and the second dedicated to the sensor 110. The storage unit 122 also comprises two modules 1221 and 1222, the first dedicated to the colorimetric setpoint values and the second to the photometric setpoint value. There are therefore two autonomous feedback control channels. The first is used for feedback control of the calorimetric parameters. It comprises the optoelectronic devices 11, the module 1211, the comparator 1232 and the control unit 124. The second is used for feedback control of the photometric parameters. It essentially comprises the electronic module 1212 and the comparator 1231. In this case, the luminance setpoint is firstly feedback-controlled and then the calorimetric parameters, as indicated in FIG. 4.

Figure 5:
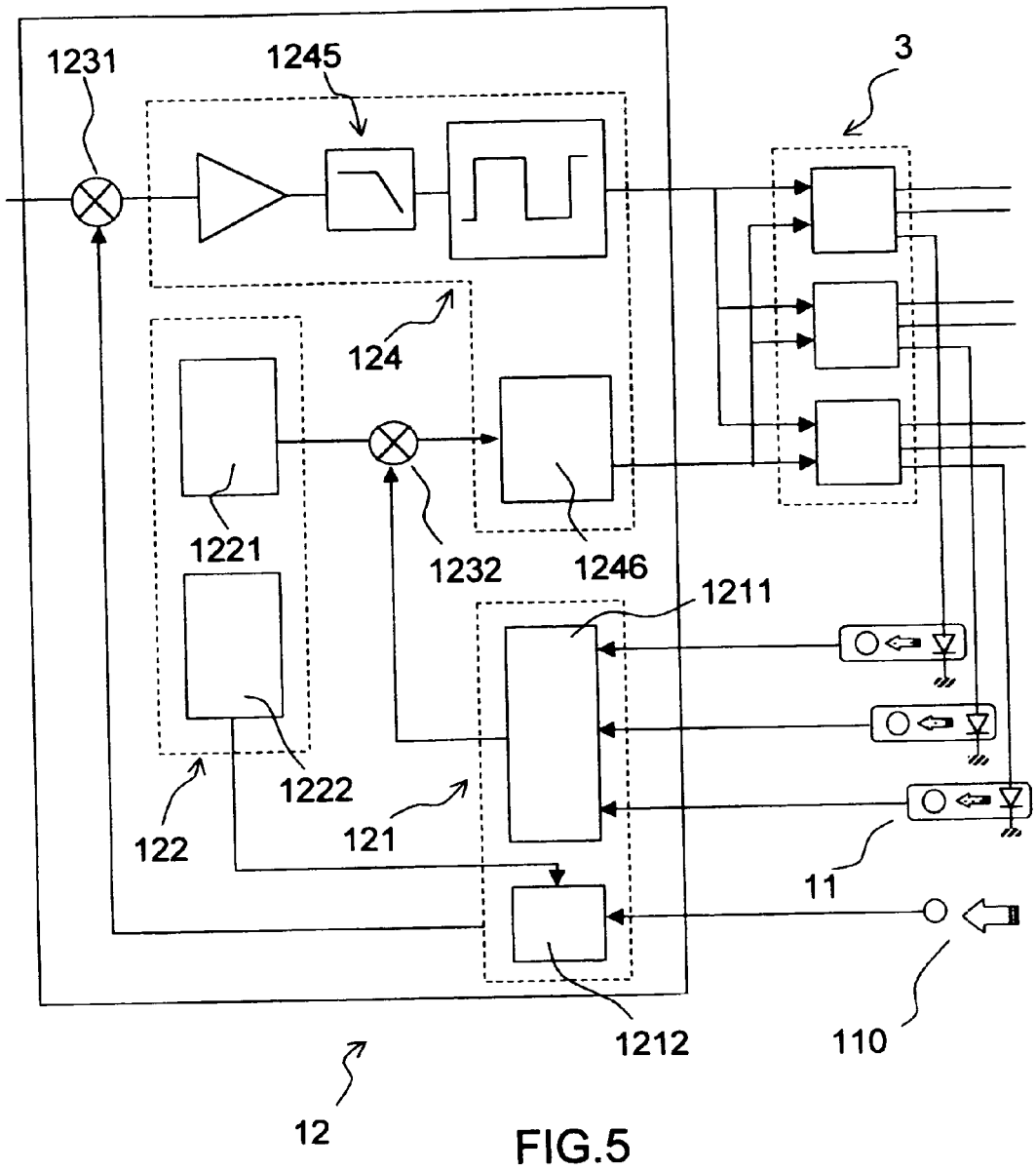
FIG. 5 shows a third embodiment of the electronic processing/computing unit of the feedback control device according to the invention.

FIG. 5 shows a second alternative embodiment of this electronic configuration when the feedback control device includes a sensor that measures the light flux directly. In this configuration, the feedback control channels for the calorimetric and photometric parameters are separate up to the electronic control circuit for the arrays of LEDs.

Thus, the luminance feedback control channel comprises the following elements:

the processing unit 1212;

the setpoint memory 1222;

the comparator 1231; and the control module 1245.

The colorimetry feedback control channel comprises the following elements:

the processing unit 1211;

the setpoint memory 1221;

the comparator 1232; and the control unit 1246.

In this case, the electronic control circuits for controlling the LEDs are controlled by two different control signals. The first control signal, output by the control module, regulates the duration of the PWM modulation delivered by the control modules 31 and thus produces the desired luminance. The second control signal output by the control module 1245 controls the electric current amplitudes delivered by the control modules 31.

The electronic feedback control device 1 according to the invention may advantageously be produced on a single electronic card that combines the electronic processing/computing unit 12 and the optoelectronic devices 11 and 110. This same electronic card may also include, on its opposite face, the light-emitting diodes of the light box. Thus, the optoelectronic devices are necessarily under environment conditions close to those of the diodes in the light box.

The invention claimed is:

1. An electronic feedback device for feedback control of photometric or colorimetric characteristics for a light box which illuminates optical-valve images, comprising:

an electronic control circuit which controls at least a first and a second array of light-emitting diodes disposed in the light box, the first array of light emitting diodes emitting light in a first spectral band, the second array of light emitting diodes emitting light in a second spectral band;

an electronic processing/computing unit driving the electronic control circuit; and optoelectronic devices for measuring photometric and colorimetric characteristics of the light-emitting diodes connected to the electronic processing/computing unit, said optoelectronic devices comprising a first optoelectronic assembly including:

a first optoelectronic light-emitting diode identical to one light emitting diode of the first and second arrays of light emitting diodes in the light box; and a photosensitive sensor placed facing said first optoelectronic light-emitting diode, said first optoelectronic light emitting diode being controlled by the electronic control circuit, said first optoelectronic assembly comprising a structure which isolates the first optoelectronic assembly from external light said first optoelectronic assembly being placed in an environment close to that of the light box, and said electronic processing/computing unit comprising:

a storage unit for storing setpoint values of the photometric and colorimetric parameters;

a processing unit for processing the data coming from the photosensitive sensor, said processing unit being connected to the optoelectronic measurement devices;

an electronic comparator for comparing the data coming from the processing unit with the setpoint values; and a control unit connected, on one side, to the electronic comparator and, on the other side, to the electronic control circuit for the arrays of light-emitting diodes, thereby making it possible to maintain the setpoint values of the photometric and colorimetric parameters.

2. The electronic feedback control device as claimed in claim 1, wherein said electronic feedback control device comprises as many different optoelectronic assemblies as there are different types of light-emitting diodes in the light box.

3. The electronic feedback control device as claimed in claim 1, wherein the optoelectronic devices include at least a second optoelectronic assembly including at least one photosensitive sensor, said sensor being placed in the light box or close to said box so as to capture part of the light generated within the light box.

4. The electronic feedback control device as claimed in claim 1, wherein the control unit controls the light emission of the diodes by at least an electronic PWM (pulse width modulation) device.

5. The electronic feedback control device as claimed in claim 1, wherein the control unit comprises:

an electronic PWM device, said electronic PMW device being connected to the electronic control circuit; and an electronic amplitude control device, said electronic amplitude control device electrically coupled to the electronic comparator and the electronic PWM device and being configured to control an amplitude of an electric current of at least one of the light-emitting diodes.

6. The electronic feedback control device as claimed in claim 1, further comprising a single electronic card that combines the electronic processing/computing unit and the optoelectronic devices.

7. The electronic feedback control device as claimed in claim 1, further comprising an electronic card which has the electronic feedback control device disposed on one face and the light-emitting diodes of the light box on a second opposite face.

8. The electronic feedback control device as claimed in claim 1 wherein the light box has three types of light-emitting diode, the first type emitting substantially green light, the second type emitting substantially red light and the third type emitting substantially blue light, and wherein simultaneous illumination of the three types of light-emitting diodes produces substantially white light.

9. A lighting unit, characterized in that it comprises at least one light box, an electronic control circuit and a feedback control device as claimed in claim 1.

10. An optical-valve display for aeronautical applications, wherein it includes a feedback control device as claimed in claim 1.

11. The electronic feedback control device as claimed in claim 1, wherein said optical valve image comprises a matrix liquid crystal display.

* * * * *